US006637623B2

(12) United States Patent
Muise et al.

(10) Patent No.: US 6,637,623 B2
(45) Date of Patent: Oct. 28, 2003

(54) BAG-IN-A-BOX SHIPPING CONTAINER

(75) Inventors: Herbert D. Muise, Tumwater, WA (US); Scott A. Wallick, Seattle, WA (US); David J. McKenna, Lacey, WA (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 10/108,277

(22) Filed: Mar. 26, 2002

(65) Prior Publication Data

US 2003/0183650 A1 Oct. 2, 2003

(51) Int. Cl.[7] ..... B67D 3/00

(52) U.S. Cl. ..... 222/105; 222/538; 222/541.6; 222/530; 229/117.31

(58) Field of Search ..... 222/105, 530, 222/529, 183, 541.6, 538; 229/117.27, 117.3–117.32, 130

(56) References Cited

U.S. PATENT DOCUMENTS

| | | | | |
|---|---|---|---|---|
| 2,973,119 A | | 2/1961 | Parker | 222/131 |
| 3,042,271 A | | 7/1962 | Winstead | 222/529 |
| 3,087,655 A | * | 4/1963 | Scholle | 222/183 |
| 3,100,587 A | | 8/1963 | Cox, Jr. | 222/105 |
| 3,599,840 A | * | 8/1971 | Speas | 222/183 |
| 4,174,051 A | | 11/1979 | Edwards et al. | 222/105 |
| 4,322,018 A | | 3/1982 | Rutter | 222/83 |
| 4,696,840 A | | 9/1987 | McCullough et al. | 220/462 |
| 4,834,255 A | * | 5/1989 | Boots | 229/199 |
| 5,156,295 A | | 10/1992 | Gordon et al. | 220/416 |

* cited by examiner

*Primary Examiner*—Kevin Shaver
*Assistant Examiner*—Stephanie Willatt
(74) *Attorney, Agent, or Firm*—Christensen O'Connor Johnson Kindness PLLC

(57) ABSTRACT

A corrugated shipping container for liquids is described. An outer container is a conventional corrugated box. This preferably has an inner corrugated liner forming corner posts. A liquid impermeable plastic bag having a spout and cap is contained within the outer box. The upper closure flaps of the container may have an opening or tear out portion for access to the spout. The neck of the spout is retained in a fixed position at a desired location at the top of the container by a saddle shaped insert having wing-like side members. The retainer ensures that the spout will be immediately accessible when desired, even though the container may have had severe handling stresses causing considerable bag movement.

7 Claims, 8 Drawing Sheets

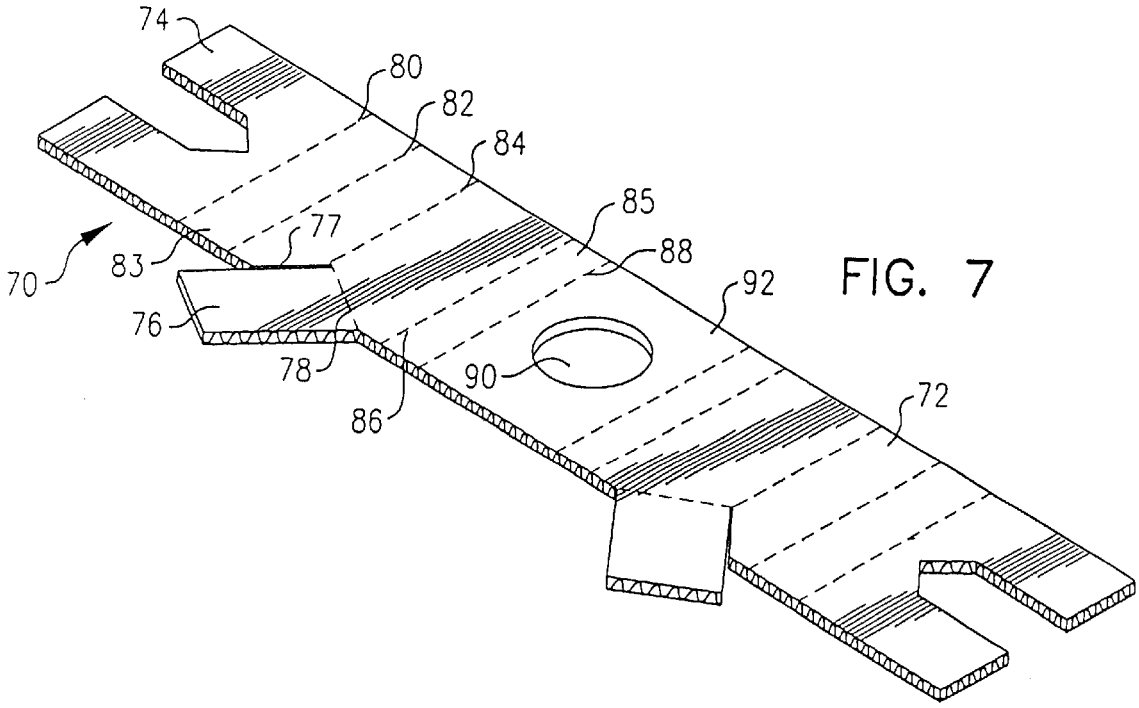
FIG. 7
FIG. 8
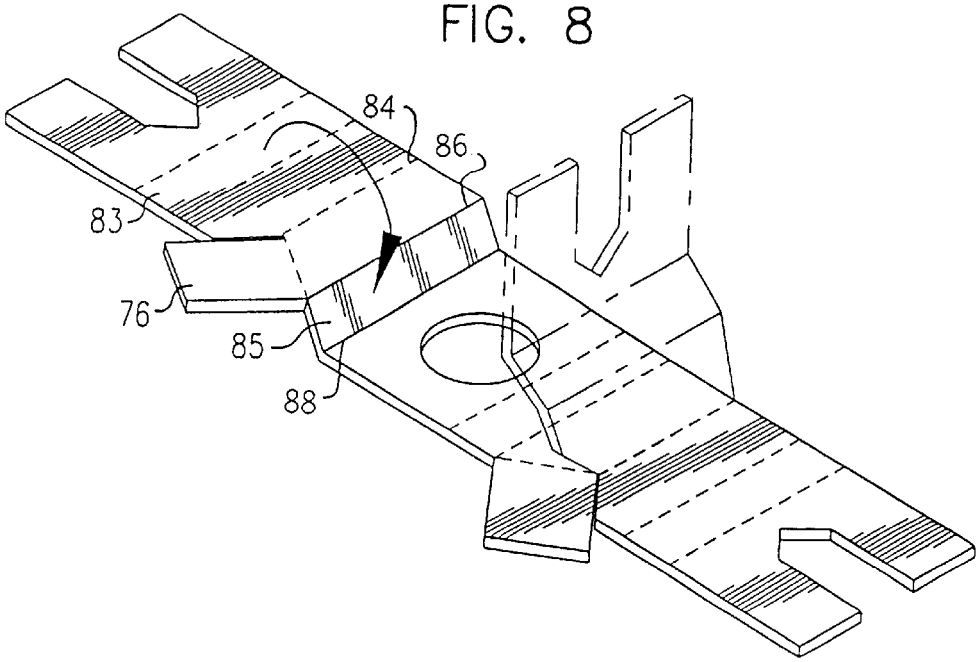

BAG-IN-A-BOX SHIPPING CONTAINER

The present invention is a shipping container having a liquid impervious bag contained within a corrugated box. The bag is equipped with a nozzle or spout providing access to the interior contents. A box member holds the spout at a predetermined location below a tearout portion of the top flaps of the container to prevent movement of the spout during handling and enable its ready access.

BACKGROUND OF THE INVENTION

It has been common practice for many years to ship liquid materials contained within plastic bags enclosed in a rigid outer container. One might note U.S. Pat. No. 4,174,051 to Edwards et al. as an example. This patent shows a corrugated box containing a flexible plastic inner container with a pull-up spout for filling and dispersing the liquid contents. The inside flaps of the top of the container have cutout portions to allow the spout to be pulled up while one of the overlying outer flaps has a corresponding hole for the spout. The hole is covered by a removable press-in dust cap when the spout is not withdrawn. In one version of the invention the inner flaps have deflectable portions that serve to maintain the spout in upright position when withdrawn. However, when the spout is collapsed within the box for storage or shipping there is no means for maintaining it in registry with the cutout portions on the flaps.

Rutter, in U.S. Pat. No. 4,322,018, is primarily directed to a valve with means to pierce an otherwise imperforate bag at the time of use. The patent shows a liquid filled bag within a corrugated paperboard container having a keyhole-shaped portion that can be opened for access to the valve.

In containers of the general type described by Rutter, the valve is entirely enclosed within the container during shipping and storage. The user removes a perforated tear out section for access to the valve which is then removed and mounted on the side of the container. It is often a source of considerable frustration on the part of the consumer to even find the valve since it frequently has moved well away from its original position adjacent the tear out during shipping.

Winstead, in U.S. Pat. No. 3,042,271, shows a cubical plastic container with a spout that can be collapsed into the top of the container to present an uninterrupted upper surface. The container is formed of relatively heavy plastic material so that it can be handled without outside support when filled. Presumably, the container might be placed within a corrugated paperbord box for additional protection during shipping and/or storage.

Cox, Jr., in U.S. Pat. No. 3,100,587 shows a liquid container having a plastic bag within a container board box. The bag has a capped pouring tube affixed by a wire tie to a tab on cut on one of the inner upper flaps of the container. When the overlying outer flap is opened the tab with its affixed tube is exposed.

Containers having a bag within a box and permanently mounted exterior spouts have also been used for many years. Exemplary among these might be noted the following U.S. Patents: Parker, U.S. Pat. No. 2,973,119; McCullough et al., U.S. Pat. No. 4,696,840; and Gordon et al., U.S. Pat. No. 5,156,295.

More commonly, liquid materials in larger quantities are shipped within metal drums or in metal or plastic buckets of various sizes. Buckets are frequently of about 5 gallon (~20 L) capacity so that they can be readily handled. These buckets have removable heads covering the entire top. Among the materials so shipped are paints and other compositions that may contain a significant percentage of suspended solid materials. Using paints as an example, the buckets are palletized for shipping and at the point of use may be placed on a shaker to redisperse the pigment and/or other solid components. The action of the shaker is quite violent, as anybody who has observed a smaller shaker in a paint store can testify. Containers must be capable of withstanding severe forces. There are significant disadvantages to shipping palletized buckets. Foremost among these is the inefficient use of space on the pallet and the hazard of the outermost buckets inadvertently slipping off the edges. Depending on the particular bucket size and configuration on the pallet, as much as half of the pallet surface may be unutilized. Another disadvantage is that the upper surface of the buckets provides an unstable and irregular bearing surface for stacking additional pallets. One proposed solution to the above problems has been to ship the paint within a plastic bag contained in a corrugated paperboard shipping container. This has had only limited success for a number of reasons. The entire inner and outer container must be strong enough to withstand the action of the shaker. While this problem can be overcome by using adequately heavy containers and interior bags, there is another deficiency that is at best a nuisance and at worst a serious liability. The interior bags usually have a spout with a removable cap that is wholly contained within the outer container until the time of use. This spout must be readily available before placing the container on the shaker. Many times the material shipped is a tint base and various customized pigments are added at the point of use. It is highly undesirable to have to open the top flaps of the container for access to the spout. With these flaps unglued the container then loses much of the strength needed on the shaker and during subsequent handling; e.g. picking the container up to pour paint into a working container. Cartons may be designed with an opening for the spout, as in the aforenoted Edwards et al. patent, but these are effective only if the spout is always located exactly under the opening. During shipping, and especially during shaking, there is a strong tendency for the filled bags to rotate within the container so that an originally properly located spout is then nowhere to be found without tearing open the top flaps.

The present invention overcomes the deficiencies just noted and provides an effective bag-within-a-box container for liquids such as paints and similar materials.

SUMMARY OF THE INVENTION

The invention is the combination of a relatively lightweight liquid tight plastic bag, having a pouring spout and removable cap, contained within a corrugated paperboard shipping container. The shipping container has a means for maintaining the spout in a fixed position below an access area located in the upper surface. The outer portion of the container is in the usual form of a rectangular parallelepiped. It has side walls with upper and lower end portions closed by opposing pairs of inner and outer flaps. Most preferably there is an inner corrugated paperboard reinforcing insert portion snugly adjacent the sidewalls of the outer portion. This inner portion may have truncated corners so that it assumes an octagonal cross section to provide reinforcing corner posts. The plastic bag is placed in the thus formed shipping container with the spout upward and adjacent one edge. The spout may be a fixed or telescoping type and has a basal portion adjacent the body of the bag. A generally saddle shaped insert portion is placed over the spout. The insert has a depressed central area and wing-like side members. The central area has an opening that surrounds the base of the spout.

In one configuration, the wing-like members are fixed between the inner and outer flaps at the top of the container. The insert portion thus serves to hold the spout in a fixed position within the container during shipping and downstream handling. While the saddle may be formed of any suitable material, corrugated paperboard is preferred.

In a second arrangement, the insert portion is formed on a member having the general cross sectional configuration of the outer container. It is located under both sets of upper flaps and rests on the corner posts. In this configuration the member with the saddle is not glued or otherwise restrained other than being held within the inner periphery of the container.

A third arrangement uses a saddle that also is not glued to any portion of the outer container. This saddle may have fold-down tabs that anchor it into the corner posts formed by the reinforcing insert portion. It has outer fork-like portions that are bent back to embrace the spout.

One end of each inner top flap is cut away to allow access to the spout. A corresponding portion of one outer top flap overlying the cutouts is preferably perforated to form a tearout section and allow access to the spout at the point of use. With this configuration the top flaps need not be unglued so that the container maintains its maximum strength.

As noted above, the spout may be a telescoping type or it may be of fixed configuration. However, the spout and bag must be constructed so that the spout can be depressed below the top flaps when the container is sealed.

It is an object of the present invention to provide a shipping container for liquids and similar materials that resists the rigors of shipping and downstream handling.

It is a further object to provide a lightweight container having a spout for easy access to the contents, the spout being depressed within the container for shipping and storage but readily accessible for use.

It is another object to provide a bag-within-a-box type container having a spout that remains in fixed position with regard to the upper surface of the container even under conditions of extremely severe externally applied stresses.

These and many other objects will become readily apparent upon reading the following detailed description, taken in conjunction with the drawings.

BRIEF DESCRIPTION OF THE DRAWINGS

FIGS. 7–9 represent still another configuration of a retaining means.

DESCRIPTION OF THE PREFERRED EMBODIMENTS

Figure 1:
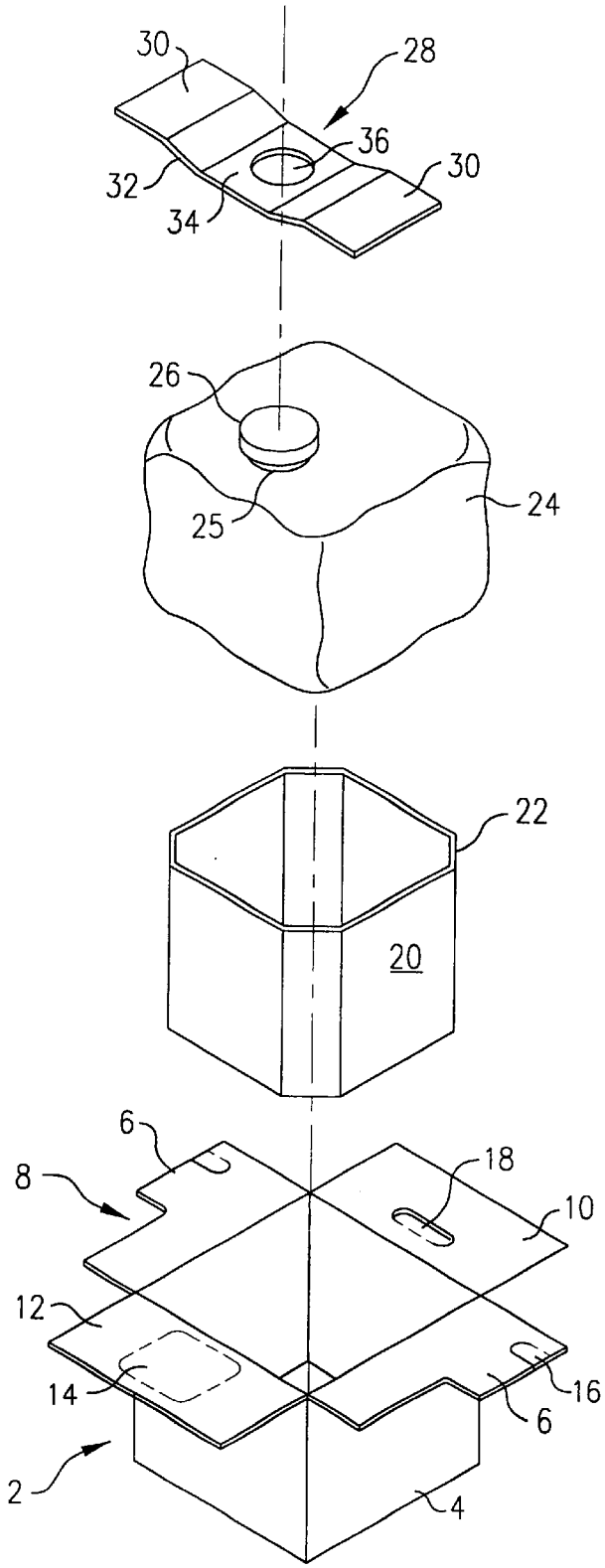
FIG. 1 is an exploded view showing the construction of one version of the liquid container.

Referring now to FIG. 1, an outer corrugated paper container is generally shown at 2. This will have a body portion 4 with inner flaps 6 and outer flaps 10, 12 at the top. The inner flaps have cutout corners 8 to allow access to the spout on the plastic inner bag 24. The inner flaps may optionally have slits 16 and outer flap 10 a slit 18 that form a handhold for pouring. Preferably these are cut free on the forward edge and hinged on the back edge to give additional strength. They can simply be pushed inward at the time of use.

Fitted snugly within the outer corrugated container is an inner liner 20 having truncated corners 22. The octagon so formed provides corner posts that significantly strengthen the container.

A relatively thin plastic bag 24 is placed within the corrugated container. The bag has a spout 25 with a screw cap 26. A pull loop, not shown, may be attached to the cap or spout to aid in withdrawal. While the bag shown is generally cubic, other configurations, such as flat bags, are equally suitable.

A saddle-shaped part, generally shown at 28, surrounds the base of the spout, underlying cap 26. This has wing portions 30, angled risers 32, and a basal section 34. An opening 36 is centered on the basal section to accept spout 25.

Figure 2:
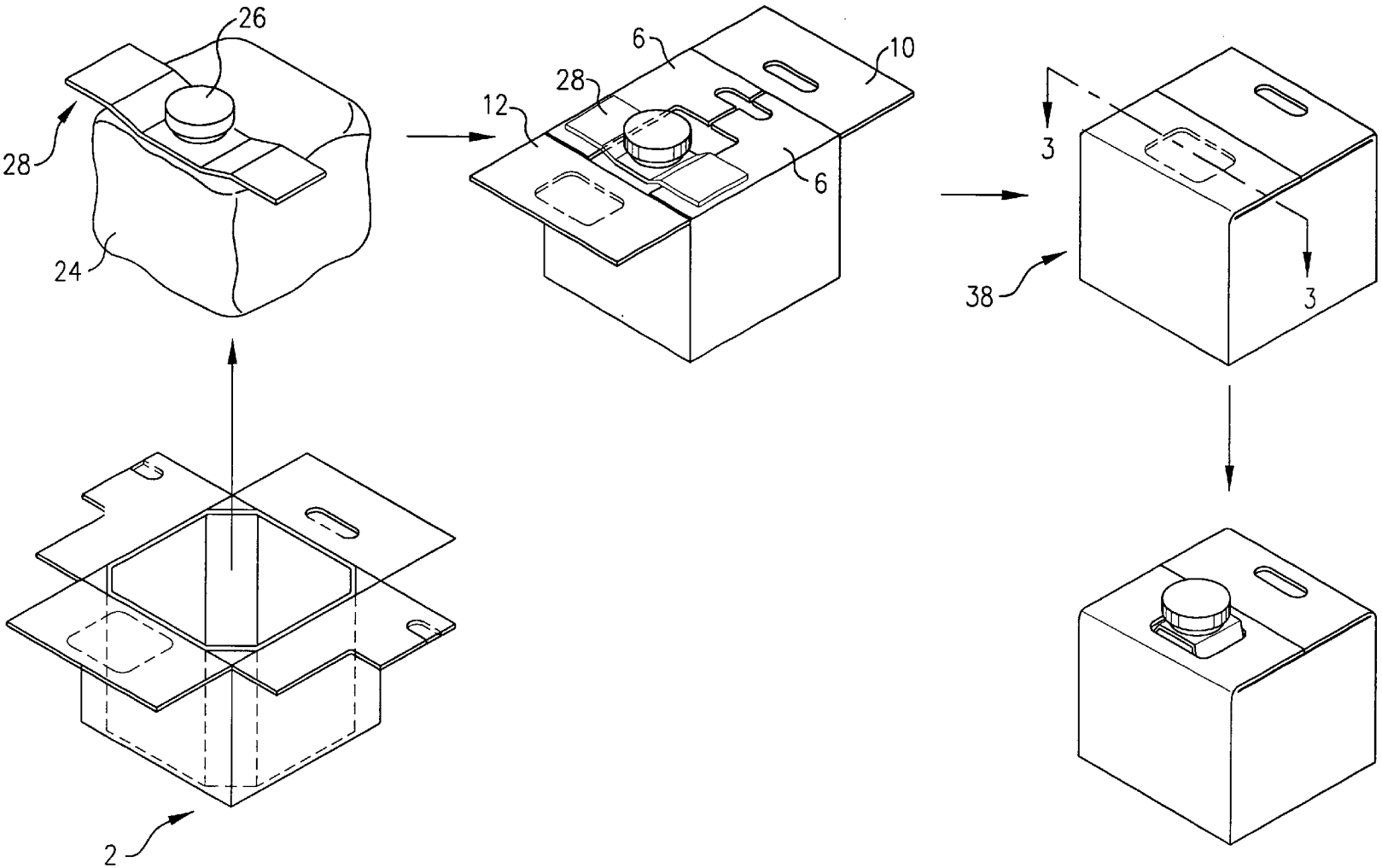
FIG. 2 is a diagrammatic sketch of the steps of assembly of the container components using the first spout retainer arrangement and an illustration of the container ready for pouring out its contents.

FIG. 2 shows how the version of FIG. 1 is assembled. The bag 24, with saddle 28 in place, is placed in reinforced corrugated container 2. Side flaps 6 are closed with saddle 28 resting on top of them. Normally saddle 28 would be glued to the side flaps but any other method of attachment; e.g., stapling or tabs inserted through punched holes, is equally acceptable. Plastic bag 24 may be filled either before of after insertion into the reinforced corrugated container. Finally top flaps 10, 12 are closed and glued in place to create the filled, ready to ship, container 38. The final drawing shows the spout withdrawn, ready to empty the contents.

Again using paint as an example of the product packaged, at the point of use pigments might or might not be added. Then the filled container is placed on a shaker for an adequate period to give a homogeneous product. The forces acting on the package are extreme during this operation. Either before or after shaking the perforated tear out section 14 is removed and the contents can then be poured out into a working container.

Figure 3:
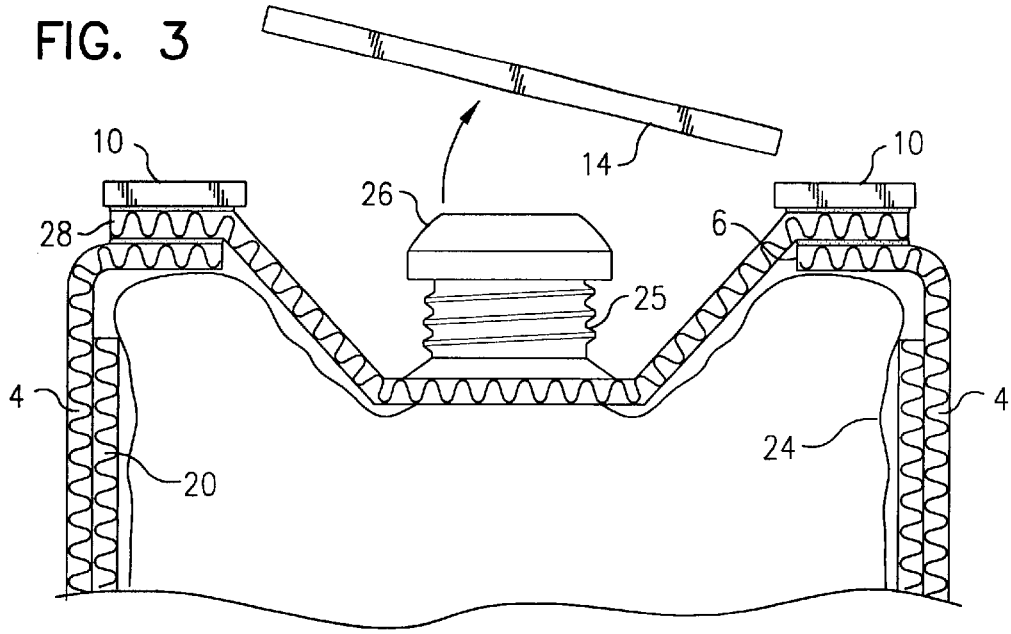
FIGS. 3 and 4 are partial cross sections along line 3—3 of FIG. 2 showing the spout area when packaged and when ready for use.
Figure 4:
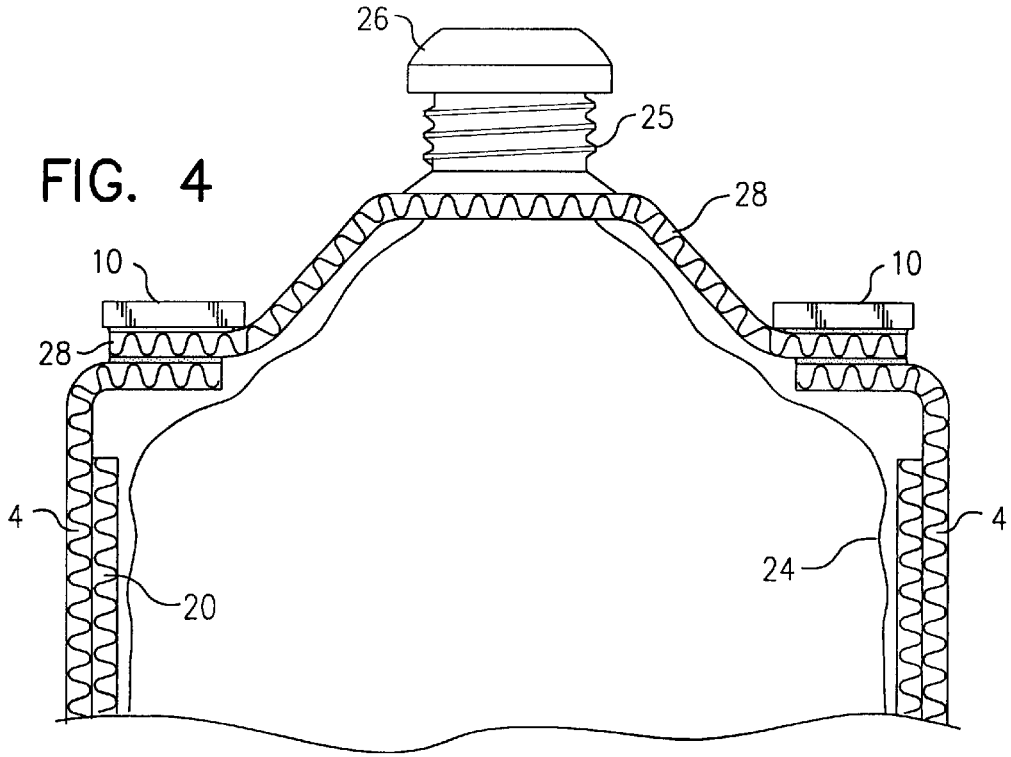

FIG. 3 is a partial vertical cross section of the package in the area of the spout as it would be seen immediately prior to being withdrawn. Tear out section 14 has just been removed but the top of cap 26 is still below the plane defined by the outer flaps. FIG. 4 shows the spout pulled up so that the contents may be emptied. Saddle 28 remains attached and is pulled up into a generally arched configuration along with the spout.

Figure 5:
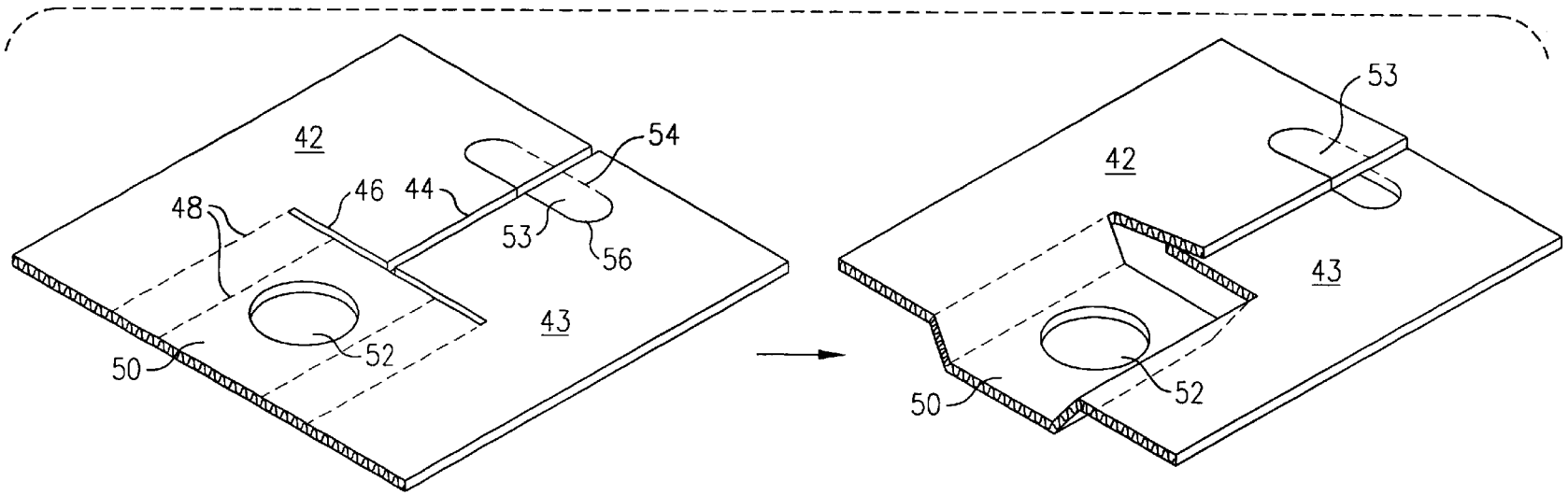
FIGS. 5 and 6 show variations of an alternative retaining means for the spout.
Figure 6:
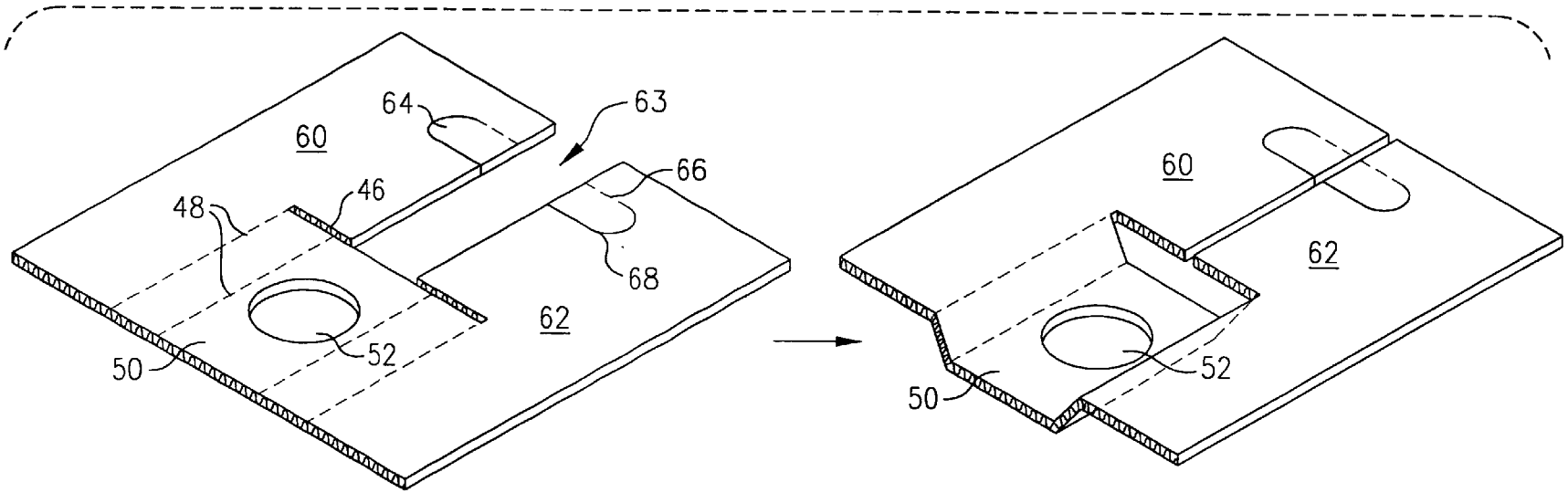

FIGS. 5 and 6 show alternative configurations that replace saddle 28. Both are cut from flat pieces, preferably corrugated paperboard, although other materials would be equally satisfactory. Both alternatives are configured to fit within the inside of the container. They lie on top of the bag and its contents and rest in the corner posts but are entirely below the inner and outer flaps. In FIG. 5, side pieces 42 and 43 are separated by T-shaped slits 44, 46. Score lines 48 are made to enable precise folding, as seen in the right hand drawing. Section 50 corresponds to basal portion 34 in the simple saddle of the earlier figures. Opening 52 accepts the neck of the spout. The optional hand hole has a score line 54 and a slitted portion 56. The central portion of the hand hole 53 may be removed but preferably is left so as to provide additional strength and a better grip for the user. The side edges of the flat member in the left hand drawing are pushed together to create the saddle and configuration shown in the right hand drawing. Side portions 42 and 43 are allowed to overlap, providing additional strength. A somewhat different configuration is seen in FIG. 6. Side portions 60 and 62 are separated by a gap 63 which is sized so that no overlap occurs when the sides are directed toward each other to form the saddle. The optional hand hold 64, 66, and 68 is analogous to those of the earlier figures.

The variants of FIGS. 5 and 6 have the advantage that they do not need to be glued. This is a significant convenience in assembling the filled package.

Figure 9:
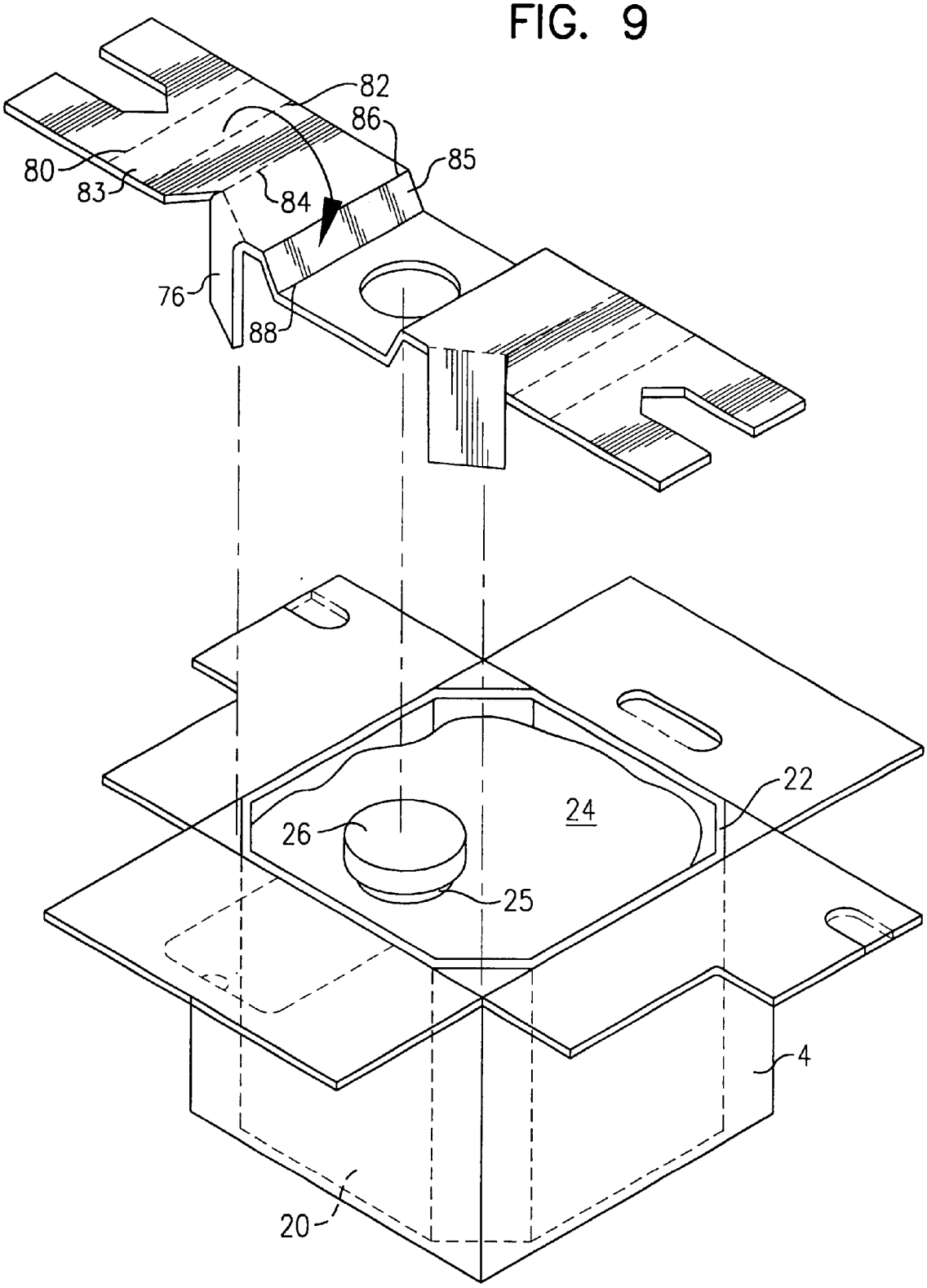

FIGS. 7–9 show yet another retainer means 70 that does not need to be glued. This retainer has the particular advantage that it may be conveniently inserted after the bag is filled with its contents and capped. As seen in FIG. 7, a strip of a material 72, such as a lightweight corrugated board, is cut to provide forked ends 74 and outwardly extending tabs 76. The tabs are supplied on one side with a cut or slit 77 so that they can be bend downwardly along score line 78. Transverse score lines 80, 82, 84, 86, and 88, are also provided for bending the retainer as will be shown in the subsequent figures. A centrally located aperture 90 permits passage of the spout on the bag. Since the retainer is symmetrical about a line drawn transversely through the center of aperture 90 the corresponding elements to the right have not been separately numbered.

FIGS. 8–9 show how the retainer is put in place. The retainer is first folded as shown in FIG. 8 along score lines 84 and 86 forming short panels 85. Tabs 76 are bent down along score lines 78. At this point the retainer would then be slipped over cap 26 of the jug 24, which may be either filled or empty (FIG. 9). Aperture 90 is sized so as to pass cap 26. Central panel 92 lies on top of the plastic bag 24. Tabs 76 are inserted into corner posts 22 formed by insert 20 in outer container 4 (refer also to FIG. 1). Next, one end is folded back on itself along score line 84. Bends are also made along score lines 80 and 82 forming short panel 83, which corresponds to and lies atop short panel 85. Simultaneously, one forked end 74 is slipped around the neck 25 of the bag 24. The other end of the retainer is folded in similar fashion. The notch in the forked ends may be made slightly narrower than aperture 90 to closely embrace neck 25 of the plastic bag. In that way the retainer is held securely in place under the cap.

Figure 10:
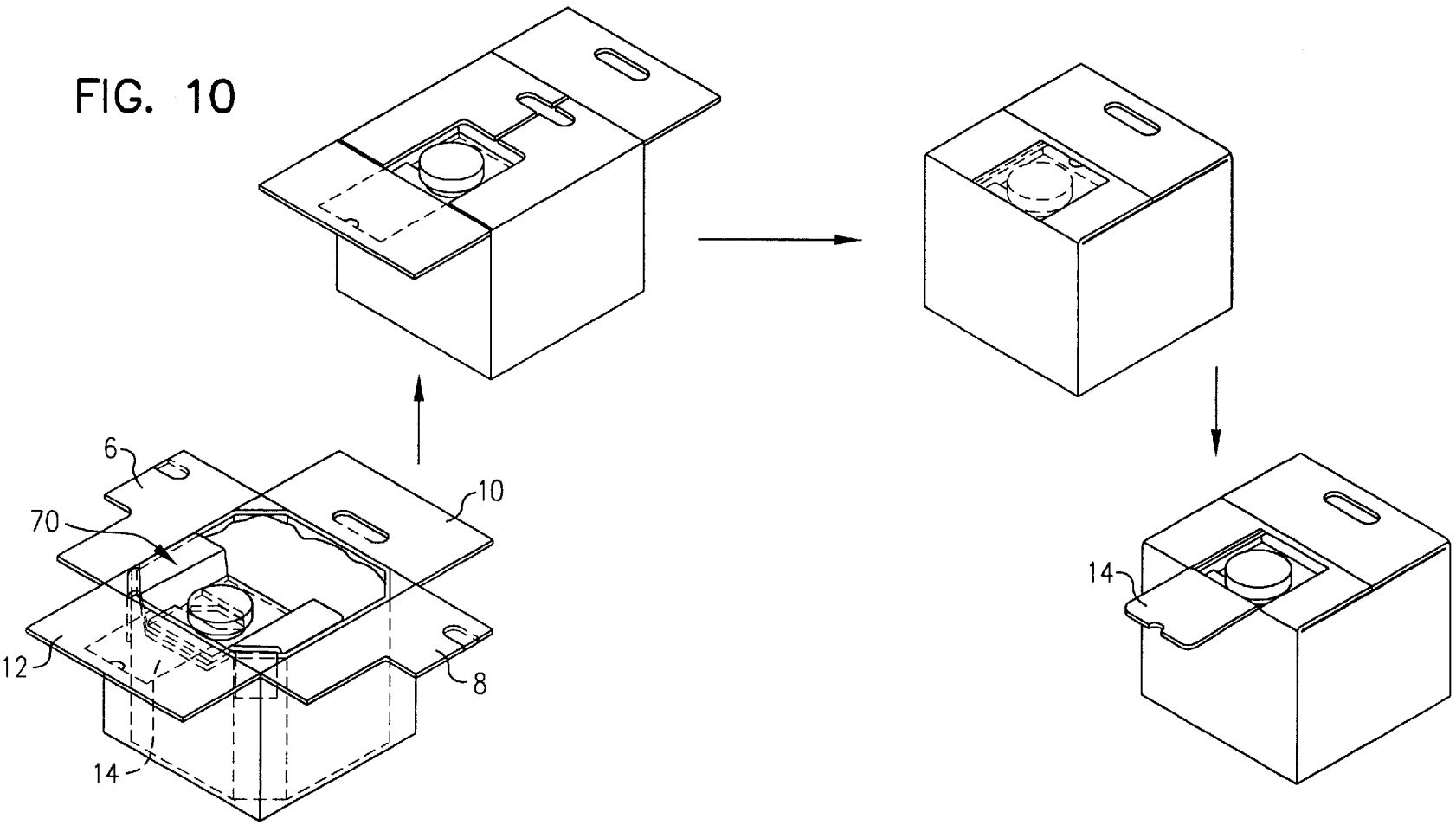
FIG. 10 is a diagrammatic sketch using the retaining means of FIGS. 7–9, showing the steps of assembly of the container components and an illustration of the container ready for pouring out its contents.

FIG. 10, with the retainer of FIGS. 7–9 now in place, shows the final steps in assembly of the container for shipping and use. The right hand portion of FIG. 10 shows tear out flap 14 open for access to the spout as might be required for adding pigment to a paint tint base or for pouring out the contents of the container.

EXAMPLE

A regular shipping container approximately 14 inches high and of 10 inch square cross section was formed from corrugated board having 56 pound liners and 36 pound corrugated medium. An insert providing corner posts was formed from the same corrugated board as the outer container. A 21 in wide (between the seams) double walled flat plastic bag was used as the inner container. A saddle having the configuration of those shown in FIGS. 1 and 2, of similar board weight, was inserted around the bag spout and glued in place between the inner and outer flaps. The bag was then filled with approximately 5 gallons of paint, weighing approximately 60 pounds. The filled box was placed on a commercial shaker adjusted to a compression value of about 1100 pounds. Shaking times as long as 3 minutes and 20 seconds did not damage the box in any significant way. Upon opening the tear out portion on the top flap the spout was still in the original position, ready to be pulled out, so that the contents could be emptied. Similar results were found using the spout retainer described in FIGS. 5 and 6 and 7 to 10.

While the best known modes of construction of the liquid container have been described, it will be apparent that variations could be made that have not been shown herein. It is the inventors' intent that these variations should be considered to be within the scope of the invention if encompassed within the following claims.

What is claimed is:

1. A shipping container which comprises;

a corrugated paperboard outer box having the overall configuration of a rectangular parallelepiped, the box having sidewalls and upper and lower end portions, the end portions comprising opposing inner and outer flaps;

a corrugated paperboard insert portion snugly adjacent the sidewalls, the insert portion configured with truncated corners to form an octagonal cross section and provide reinforcing corner posts;

a flexible, liquid impermeable, bag within the interior of the container, the bag having a spout with a basal portion and a removable cap, the flaps of the upper end portion of the outer box having an aperture or tear out section adjacent the spout for access to the spout; and a spout retainer having an outer configuration geometrically similar to and sized to have essentially the inner dimensions of the outer container so as to fit snugly therein, the spout retainer having a depressed saddle shaped portion with an aperture surrounding the basal portion of the spout, the retainer being held in a fixed position against the liquid impermeable bag and beneath the upper end inner flaps of the outer container so as to prevent significant displacement of the spout away from the access location.

2. The container of claim 1 in which one end of each inner upper flap is cut away to expose the spout and the portion of one outer flap overlying the cutout is perforated to provide a tear-out section and give access to the spout.

3. The container of claim 1 in which the spout retaining insert portion is formed from corrugated paperboard.

4. The container of claim 1 in which the spout is telescoping so that it can be located entirely within the container during storage and shipping but elevated above the container to allow the contents to be readily poured out.

5. The container of claim 1 in which the spout retainer is formed from corrugated paperboard.

6. A shipping container which comprises;

a corrugated paperboard outer box having the overall configuration of a rectangular parallele-piped, the box having sidewalls and upper and lower end portions, the end portions comprising opposing inner and outer flaps;

a corrugated paperboard insert portion snugly adjacent the sidewalls, the insert portion configured with truncated comers to form an octagonal cross section and provide reinforcing corner posts;

a flexible, liquid impermeable, bag within the interior of the container, the bag having a spout with a basal portion and a removable cap, the flaps of the upper end portion of the outer box having an aperture or tear out section adjacent the spout for access to the spout; and a spout retainer extending from side to side within the outer container and having a saddle portion with extended fork-like side portions that are bent back to embrace the spout.

7. The container of claim 6, which the spout retainer has fold-down tabs located in the corner posts to lock it in place.

* * * * *